US007990062B2

(12) United States Patent
Liu

(10) Patent No.: US 7,990,062 B2
(45) Date of Patent: Aug. 2, 2011

(54) LED LAMP

(75) Inventor: Tay-Jian Liu, Taipei Hsien (TW)

(73) Assignee: Foxconn Technology Co., Ltd., Tu-Cheng, New Taipei (TW)

( * ) Notice: Subject to any disclaimer, the term of this patent is extended or adjusted under 35 U.S.C. 154(b) by 96 days.

(21) Appl. No.: 12/625,532

(22) Filed: Nov. 24, 2009

(65) Prior Publication Data

US 2011/0050072 A1 Mar. 3, 2011

(30) Foreign Application Priority Data

Aug. 31, 2009 (CN) ..... 2009 1 0306372

(51) Int. Cl.
*H01J 1/62* (2006.01)

(52) U.S. Cl. ..... 313/512

(58) Field of Classification Search ..... 362/218, 362/373, 264, 270, 287, 289, 345; 313/46, 313/498–512
See application file for complete search history.

(56) References Cited

U.S. PATENT DOCUMENTS

2002/0136010 A1* 9/2002 Luk ..... 362/250
2010/0314984 A1* 12/2010 Lee ..... 313/46
* cited by examiner

*Primary Examiner* — Anne M Hines
*Assistant Examiner* — Jacob Stern
(74) *Attorney, Agent, or Firm* — Frank R. Niranjan

(57) ABSTRACT

An LED lamp includes a heat dissipation part, an optical part and an electric part. The optical part includes an LED module attached to a heat dissipation member of the heat dissipation part and an envelope covering the LED module. The electric part includes a casing, a circuit board and a lamp cap. The casing includes a bottom plate and an annular sidewall extending from a periphery of the bottom plate to connect with the heat dissipation part and the optical part. The lamp cap includes an electric shell and an electric pole axially inserted in the electric shell. The lamp cap is rotatablely connected to the casing via the electric pole. The electric pole is fixedly connected to and electrically insulated from the electric shell. An orientation-adjusting structure is provided between the casing and the lamp cap for adjusting the illumination direction of the LED lamp.

14 Claims, 9 Drawing Sheets

LED LAMP

BACKGROUND

1. Technical Field

The disclosure generally relates to light emitting diode (LED) lamps, and particularly to an LED lamp with an adjustable illumination direction.

2. Description of Related Art

LEDs (light emitting diodes) are preferred for use in LED lamps rather than CCFLs (cold cathode fluorescent lamps) and other traditional lamps due to their excellent properties, including high brightness, low power consumption, long lifespan, environment friendliness, rapid start-up, directivity, and et al.

Nowadays, screw-type LED lamps are widely used. The screw-type LED lamp is provided with a screw-type lamp cap at one end thereof for electrically connecting the LED lamp with an external power source. Generally, the screw-type LED lamps emit light outwardly around a whole outer circumferential surface thereof. In use, the screw-type lamp cap of the LED lamp is screwed into a screw-type lamp holder which is electrically connected with the external power source, until the screw-type lamp cap is firmly fixed in and electrically connected with the screw-type lamp holder to ensure a good electrical connection between the screw-type lamp cap and the screw-type lamp holder.

However, some screw-type LED lamps are designed to emit light only through a portion of an outer circumferential surface of the LED lamp. Therefore, the screw-type LED lamp is often required to be turned from a first position to a second position so that the emitted light can illuminate on the desired objects at the second position. However, after the screw-type LED lamp is turned from the first position to the second position, the screw-type lamp cap may be electrically disengaged from the screw-type lamp holder to cause an electrical connection between the screw-type LED lamp and the screw-type lamp holder to be interrupted.

Therefore, it is desirable to provide an LED lamp with an illumination direction thereof being adjustable.

BRIEF DESCRIPTION OF THE DRAWINGS

Many aspects of the present embodiment can be better understood with reference to the following drawings. The components in the drawings are not necessarily drawn to scale, the emphasis instead being placed upon clearly illustrating the principles of the present embodiment. Moreover, in the drawings, like reference numerals designate corresponding parts throughout the several views.

DETAILED DESCRIPTION

Figure 1:
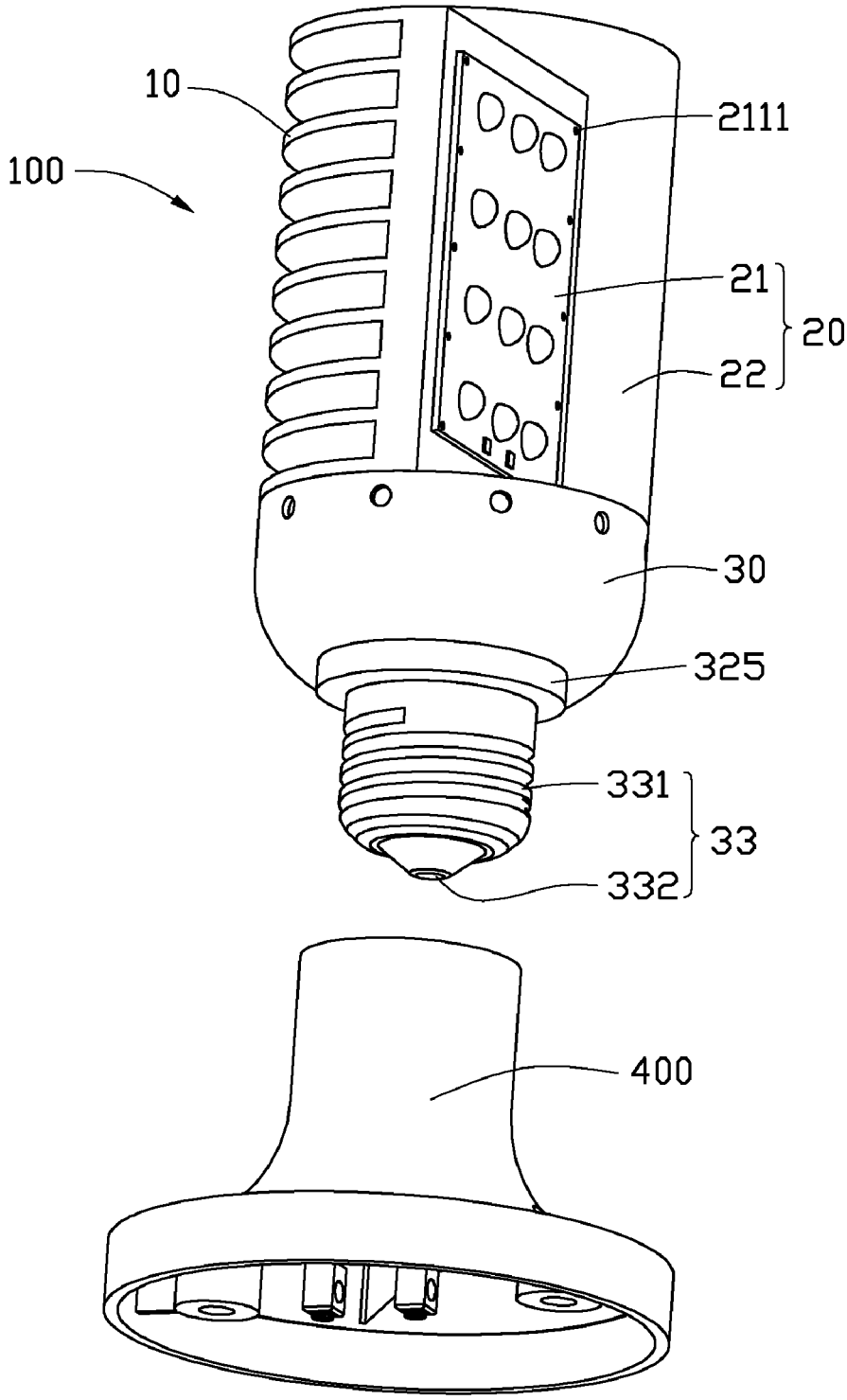
FIG. 1 is an isometric view of an LED lamp in accordance with a first embodiment of the present disclosure and a conventional lamp holder for electrical and mechanical mounting of the LED lamp thereon.
Figure 2:
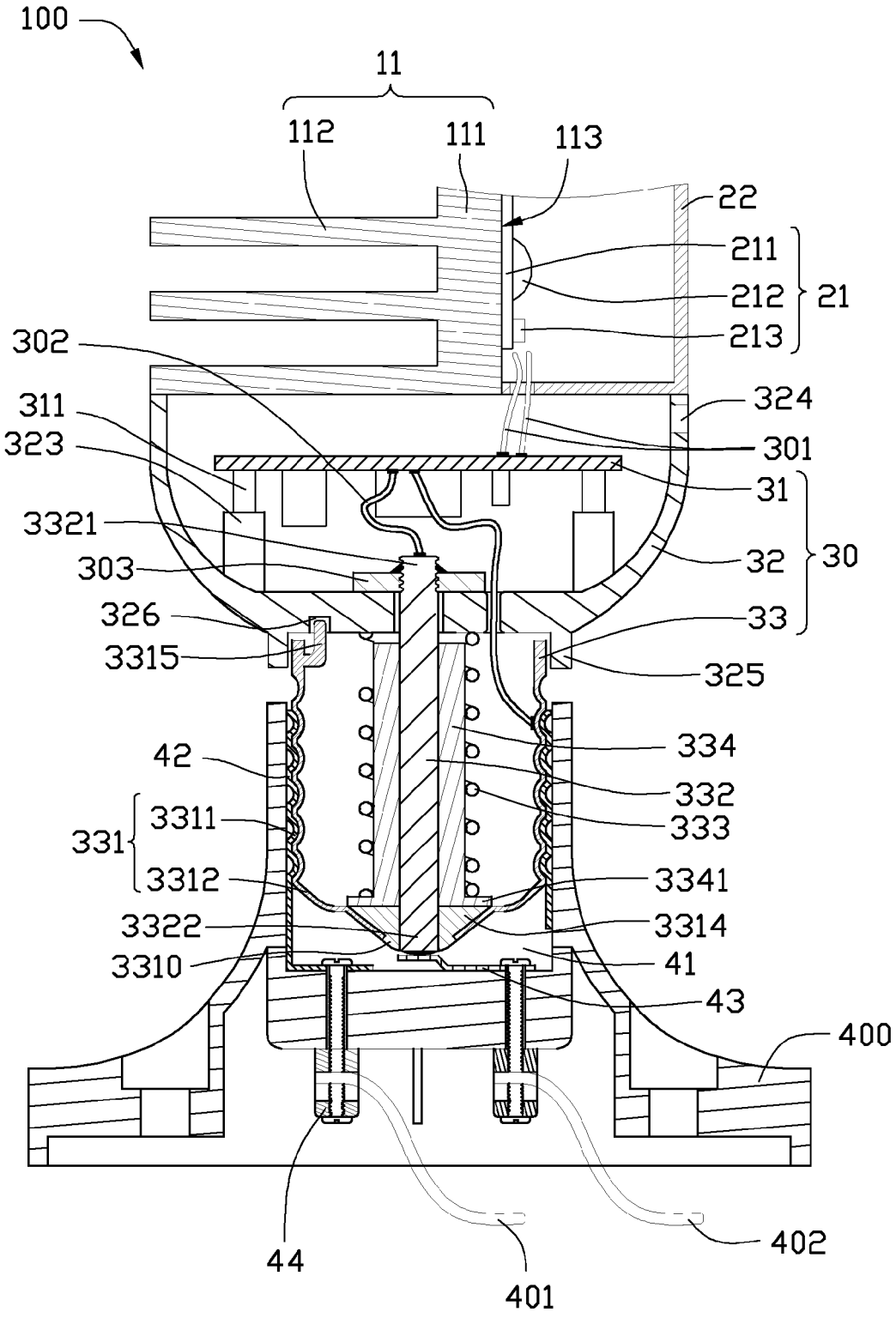
FIG. 2 is cross-sectional view showing the LED lamp and the lamp holder of FIG. 1 being assembled together.

Referring to FIGS. 1 and 2, an LED lamp 100 according to a first embodiment of the present disclosure includes a heat dissipation part 10, an optical part 20, and an electric part 30. The LED lamp 100 can be mounted to a conventional lamp holder 400 to obtain electric current from an external power source to emit light.

The heat dissipation part 10 includes a heat dissipation member 11. The heat dissipation member 11 is made of a material having a high thermal conductivity, such as aluminum or aluminum alloy. The heat dissipation member 11 includes a vertical base 111 and a plurality of fins 112 extending horizontally outwardly from a left side of the base 111. The base 111 is rectangular. The fins 112 are semicircular and spaced from each other along a lengthwise direction of the base 111. A diameter of the fin 112 is equal to a width of the base 111. A right side of the base 111 forms a heat absorbing surface 113.

The optical part 20 is arranged at a right side of the heat dissipation part 10. The optical part 20 includes an LED module 21 and an envelope 22 covering the LED module 21. The LED module 21 includes a substrate 211, a plurality of LEDs 212 arranged on the substrate 211, and a plurality of electrodes 213 formed on the substrate 211. The LEDs 212 are evenly spaced from each other and electrically connected to the substrate 211 with emitting surfaces thereof facing the envelope 22. The substrate 211 of the LED module 21 is rectangular and attached on the heat absorbing surface 113 of the heat dissipation member 11, whereby heat generated by the LEDs 212 is conducted to the heat dissipation member 11 via the substrate 211 for dissipation. A layer of thermal interface material (TIM) may be applied between the substrate 211 of the LED module 21 and the heat absorbing surface 113 of the heat dissipation member 11 to eliminate an air interstice therebetween, to thereby enhance a thermal conduction efficiency between the LED module 21 and the heat dissipation member 11. The substrate 211 defines a plurality of mounting holes 2111 near oppositely lateral edges thereof. Fasters (not shown) such as screws are used to extend through the mounting holes 2111 to fix the substrate 211 of the LED module 21 onto the heat absorbing surface 113 of the heat dissipation member 11. Alternatively, the substrate 211 of the LED module 21 can be attached to the heat absorbing surface 113 of the heat dissipation member 11 fixedly and intimately through surface mount technology (SMT), whereby an interface between the substrate 211 and the base 111 can be eliminated and a thermal resistance between the LED module 21 and the heat dissipation member 11 is reduced.

The envelope 22 is transparent and has a semicircular cross section. A diameter of the cross section of the envelope 22 is equal to that of the fin 112. The envelope 22 is arranged at the right side of the base 111 of the heat dissipation member 11 and fixed on the base 111, with the LED module 21 covered by the envelope 22. The envelope 22 and the fins 112 of the heat dissipation member 11 cooperatively define an elongated, cylindrical profile of the LED lamp 100. The envelope 22 functions as an optical lens for the LED module 21 to guide light emitted by the LEDs 212 of the LED module 21 to an ambient environment and as a shell to protect the LED module 21 from dust and external damage.

The electric part 30 is arranged at a bottom end of the LED lamp 100 and connected to the heat dissipation part 10 and the optical part 20. The electric part 30 includes a circuit board 31, a casing 32 and a lamp cap 33. The circuit board 31 is received in the casing 32. The circuit board 31 has a pair of first wires 301 extending upwardly and a pair of second wires 302 extending downwardly therefrom. The first wires 301 are connected with the electrodes 213 of the LED module 21, and the second wires 302 are connected with the lamp cap 33 which is used to connect with the lamp holder 400 to get electric current to enable the LED module 21 to emit light.

The casing 32 is bowl-shaped, and has an open end facing and connecting the heat dissipation part 10 and the optical part 20. The casing 32 includes a circular bottom plate 321 and an annular sidewall 322 (see in FIG. 3) extending upwardly and outwardly from a periphery of the bottom plate 321 to connect with the heat dissipation part 10 and the optical part 20. The circuit board 31 is mounted in the casing 32 through a plurality of mounting seats 323 and a plurality of mounting poles 311 extending upwardly from the mounting seats 323. The mounting seats 323 are attached to an inner surface of the casing 32. The circuit board 31 is mounted on the mounting poles 311. A plurality of air passage apertures 324 are defined through the casing 32 at a position adjacent to the heat dissipation part 10 and the optical part 20. The air passage apertures 324 communicate an inner space of the casing 32 with the ambient environment and are utilized for dissipating heat generated by the circuit board 31.

The lamp cap 33 is arranged at a bottom end of the casing 32. The lamp cap 33 includes a cylindrical electric shell 331 and an electric pole 332 axially inserted in the electric shell 331. The electric shell 331 is made of metal sheet having a high electrical conductivity. The electric shell 331 has an opening facing the casing 32, and includes a tubular-shaped main body 3311 and a cone-shaped end plate 3312 extending downwardly from a bottom end of the main body 3311. The main body 3311 defines a plurality of threads in an outer surface thereof for engaging to the lamp holder 400. The end plate 3312 defines a through hole 3310 in a central portion thereof for insertion of the electric pole 332 therein. The electric pole 332 is made of material having a high electrical conductivity. The electric pole 332 has an inner end 3321 adjacent to the casing 32 and an outer end 3322 far from the casing 32. The electric pole 332 is axially inserted in the electric shell 331. The base 111 of the heat dissipation member 11 extends along an axial direction of the electric pole 332. The inner end 3321 and the outer end 3322 of the electric pole 332 extend axially out of two ends of the electric shell 331, respectively. A diameter of the outer end 3322 of the electric pole 332 is smaller than that of the through hole 3310 of the end plate 3312. An insulating member 3314 is attached on an inner surface of the end plate 3312 and disposed around the outer end 3322 of the electric pole 332. The electric pole 332 is fixedly connected to and electrically insulated from the end plate 3312 of the electric shell 331 by the insulating member 3314. The pair of second wires 302 of the circuit board 31 are respectively connected with an inner surface of the main body 3311 and the inner end 3321 of the electric pole 332.

Figure 3:
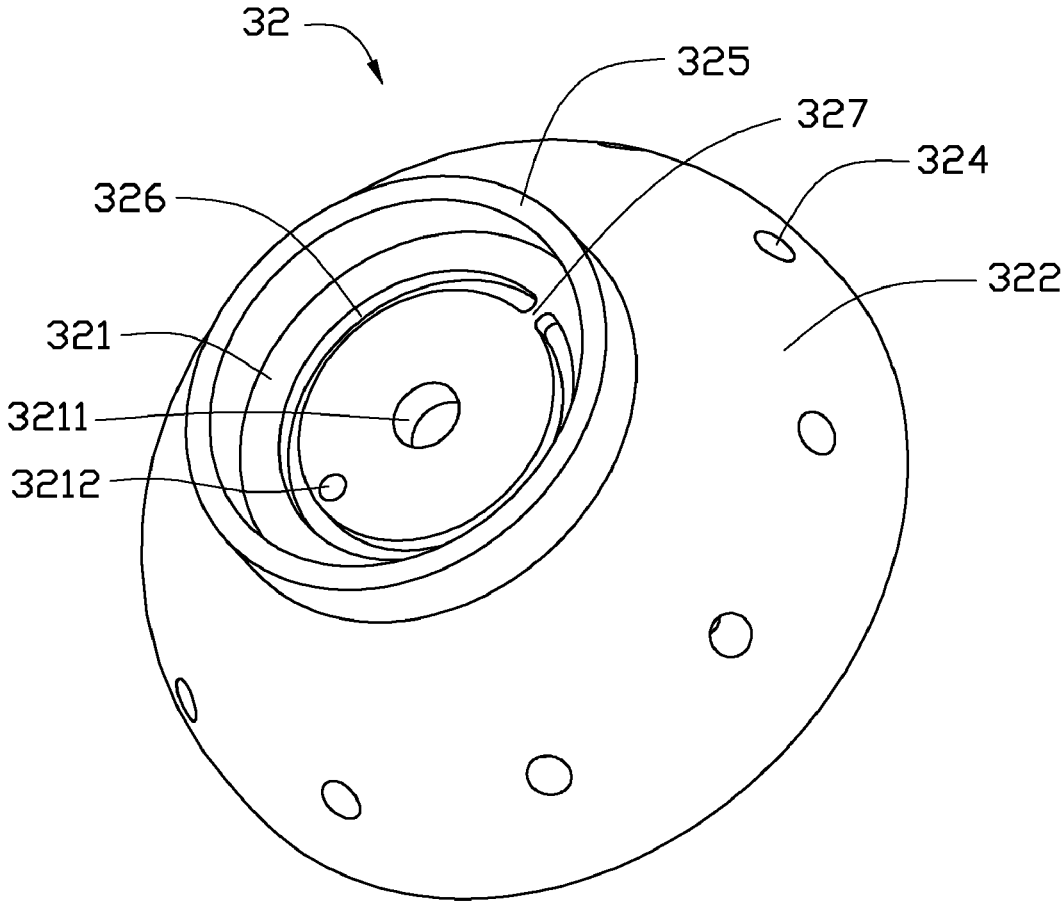
FIG. 3 is an isometric view of a casing of the LED lamp of FIG. 1 viewed from another aspect.

Referring also to FIG. 3, the bottom plate 321 of the casing 32 defines a through hole 3211 in a center portion thereof. The inner end 3321 of the electric pole 332 extends upwardly through the through hole 3211 of the bottom plate 321 of the casing 32, and then connects with a blocking member 303 arranged at an inner side of the bottom plate 321 of the casing 32. A diameter of the inner end 3321 of the electric pole 332 is smaller than that of the through hole 3211 of the bottom plate 321 of the casing 32. Therefore the lamp cap 33 is rotatablely connected to the casing 32 via the electric pole 332. In this embodiment, the blocking member 303 is a nut threadedly engaged with the inner end 3321 of the electric pole 332. The nut 303 and the electric pole 332 can be fixedly connected together by agglutinating or jointing, to thereby prevent the nut 303 from rotating relative to the electric pole 332.

A coil spring 333 is received in the electric shell 331 and disposed around the electric pole 332. The coil spring 333 is compressed between the bottom plate 321 of the casing 32 and the end plate 3312 of the electric shell 331. The coil spring 333 helps a stable connection between the lamp cap 33 and the casing 32. Further, a positioning sleeve 334 is received in the electric shell 331 and disposed around the electric pole 332. The positioning sleeve 334 is surrounded by the coil spring 333 and has an inner passage through which the electric pole 332 extends. The positioning sleeve 334 has an outer diameter sufficiently larger than that of the electric pole 332 and is securely connected with the electric pole 332. A top end of the coil spring 333 engages with the casing 32, and a bottom end of the coil spring 333 engages with an annular flange 3341 formed at a bottom end of the positioning sleeve 334. Due to the presence of the positioning sleeve 334 and the coil spring 333, the casing 32 can rotate stably relative to the lamp cap 33 when the LED lamp 100 is rotated from a first position to a second position or vice versa, wherein at any point between the first and second positions, the LED lamp 100 always electrically connects with the lamp holder 400. The annular flange 3341 at the bottom end of the positioning sleeve 334 is adjacent to the end plate 3312 of the electric shell 331 and has a bottom face connecting with a top face of the insulating member 3314.

When the lamp cap 33 of the LED lamp 100 is screwed into the lamp holder 400, in order to adjust the illumination direction of the LED lamp 100, an orientation-adjusting structure is provided between the casing 32 and the lamp cap 33. The orientation-adjusting structure includes an annular guiding groove 326 defined in the casing 32, a block 327 formed in the guiding groove 326, and a protrusion 3315 formed on a top end of the lamp cap 33. The guiding groove 326 is defined in the bottom plate 321 of the casing 32 and concentric with the through hole 3211. When the lamp cap 33 is connected to the casing 32, the protrusion 3315 of the lamp cap 33 is received in the guiding groove 326 of the casing 32. After the electric shell 331 of the lamp cap 33 has been screwed into the lamp holder 400 and before the lamp cap 33 electrically connects with the lamp holder 400 and LED lamp 100 is at the first position, the rotation of the lamp cap 33 is synchronous with and follows the rotation of the casing 32 by an engagement between a first side of the block 327 and the protrusion 3315. When the lamp cap 33 and the lamp holder 400 are electrically connected together and the LED lamp 100 is at the first position, the lamp cap 33 and the casing 32 are both stopped from rotation along the screwing-in direction. Thereafter, the casing 32 can be rotated in a reverse direction which causes the protrusion 3315 of the lamp cap 33 to slide along the guiding groove 326 in the reverse direction until the casing 32 and accordingly the LED lamp 100 reach the second position. The block 327 formed in the guiding groove 326 limits a relative rotation between the lamp cap 33 and the casing 32 within a predetermined angle between the first and second positions. When the protrusion 3315 is blocked by an opposite second side of the block 327 during the reverse rotation of the casing 32, the casing 32 and accordingly the LED lamp 100 reach the second position. A further rotation of the casing 32 from the second position in the reverse direction causes the lamp cap 23 to also rotate in the reverse direction, whereby the lamp cap 23 is loosened from the lamp holder 400. Detailed explanations are given below.

In this embodiment, the guiding groove 326 of the casing 32 is defined in an outer surface of the bottom plate 321, and the protrusion 3315 of the lamp cap 33 is formed on an end of the electric shell 331 adjacent to the casing 32 and extends towards the casing 32. Further, an annular protecting wall 325 is formed on the outer surface of the bottom plate 321 of the casing 32 and concentric with the through hole 3211. The protecting wall 325 is disposed around the electric shell 331 of the lamp cap 33 to guide the rotation of the electric shell 331 and to prevent people from touching the electric shell 331, to thereby improve the safety of the LED lamp 100. The bottom plate 321 of the casing 32 further defines a wire hole 3212 therein for passing of one of the pair of second wire 302 which is electrically connected between the circuit board 31 and the inner surface of the electric shell 331.

The lamp holder 400 is a conventional one and defines a cavity 41 therein for receiving the lamp cap 33 of the LED lamp 100. The cavity 41 is substantially cylindrical. The lamp holder 400 includes a screw cap 42 attached on an inner surface of the cavity 41 and a resilient flake 43 mounted at a central portion of a bottom end of the cavity 41. The screw cap 42 and the resilient flake 43 are respectively connected with a naught wire 401 and a live wire 402 of the external power source via two connectors 44.

Referring to FIG. 2, in assembling the LED lamp 100 onto the lamp holder 400, the lamp cap 33 of the LED lamp 100 is screwed into the cavity 41 of the lamp holder 400. As the lamp cap 33 is screwed into the lamp holder 400 by rotating the casing 32, firstly, the protrusion 3315 of the lamp cap 33 slides along the guiding groove 326 relative to the casing 32 until the protrusion 3315 meets the first side of the block 327 formed in the guiding groove 326. Then the lamp cap 33 is rotated together with the casing 32, driving the electric shell 331 to rotate in the screw cap 42 of the lamp holder 400 until the outer end 3322 of the electric pole 332 intimately contacts with the resilient flake 43 of the lamp holder 400. Thus, the electric shell 331 and the electric pole 332 of the lamp cap 33 are respectively electrically connected to the screw cap 42 and the resilient flake 43 of the lamp holder 400. After the electric shell 331 of the lamp cap 33 had been screwed into the lamp holder 400, by rotating the casing 32 reversely, the protrusion 3315 of the lamp cap 33 is disengaged from the block 327 and slides along the guiding groove 326 relative to the casing 32 towards a reverse direction. The lamp cap 33 is not rotated together with the casing 32 and can keep a good electrical connection with the resilient flake 43 of the lamp holder 400 well until the protrusion 3315 of the lamp cap 33 meets the opposite second side of the block 327 formed in the guiding groove 326. Therefore, the LED lamp 100 can be easily adjusted to a desire position by reversely rotating the casing 32 at a proper angle after the electric shell 331 of the lamp cap 33 is screwed into the lamp holder 400. In this adjusting process, the elastic force provided by the coil spring 333 keeps the casing 32 rotating stably relative to the lamp cap 33.

Figure 4:
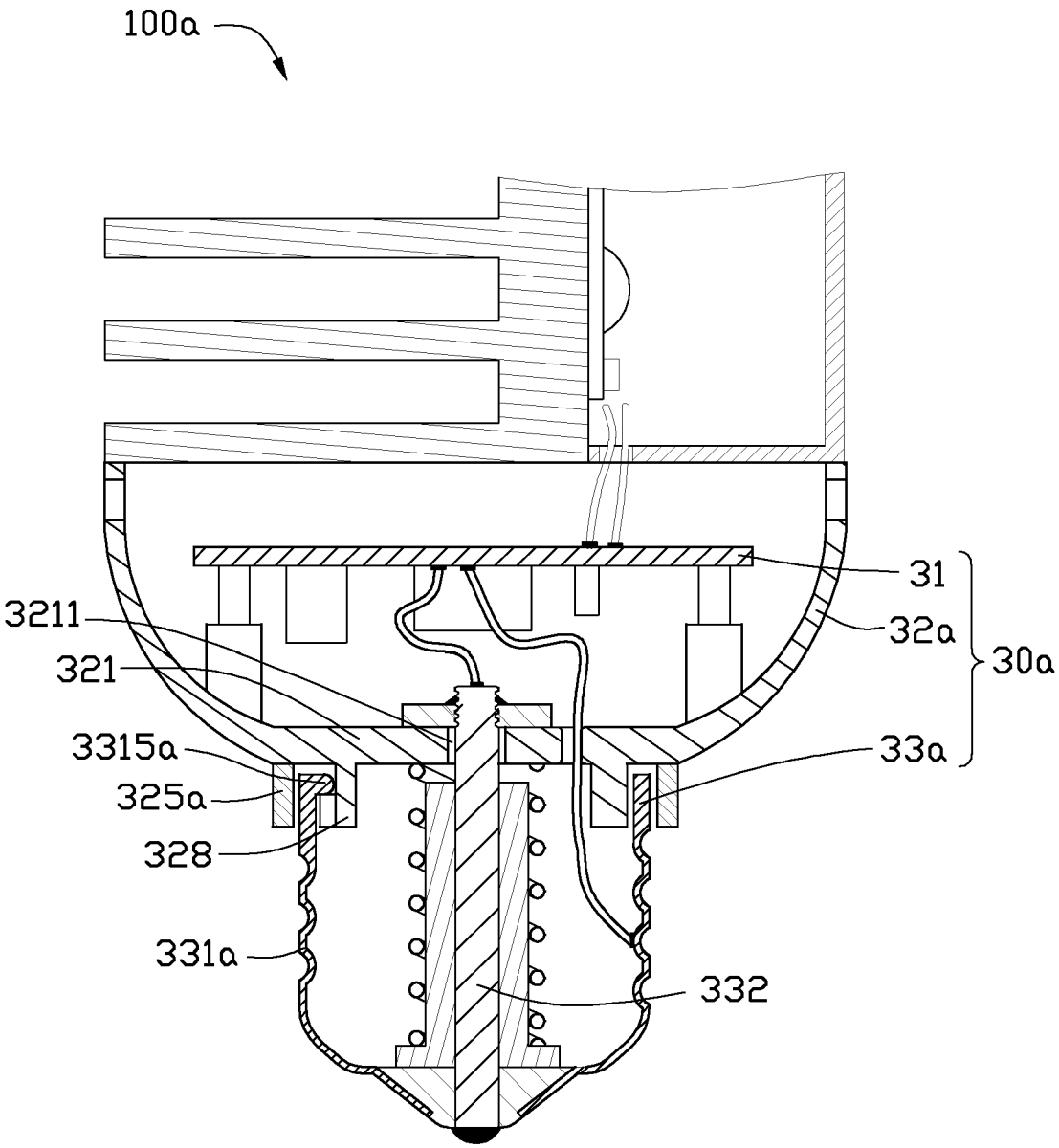
FIG. 4 is a cross-sectional view of an LED lamp in accordance with a second embodiment of the present disclosure.
Figure 5:
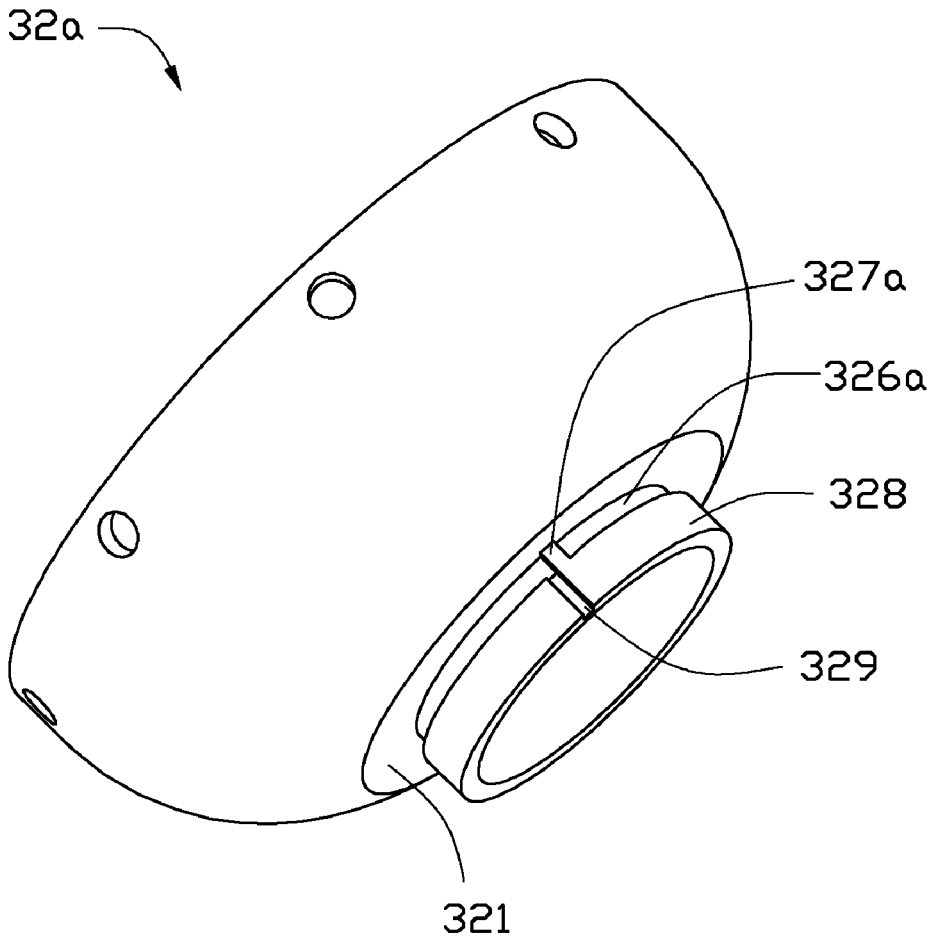
FIG. 5 is an isometric view of a casing of the LED lamp of FIG. 4.

Referring to FIGS. 4 and 5, an LED lamp 100*a* according to a second embodiment is illustrated. The difference between the LED lamp 100*a* of this embodiment and the LED lamp 100 of the first embodiment only lies in the position of an orientation-adjusting structure. In this embodiment, an electric part 30*a* of the LED lamp 100*a* includes the circuit board 31, a casing 32*a* and a lamp cap 33*a*. The lamp cap 33*a* is rotatablely connected to the casing 32*a*. The orientation-adjusting structure is provided between the casing 32*a* and the lamp cap 33*a*. The orientation-adjusting structure includes an annular guiding groove 326*a* defined in the casing 32*a*, a block 327*a* formed in the guiding groove 326*a*, and a protrusion 3315*a* formed on the lamp cap 33*a*. When the lamp cap 33*a* is rotatablely connected to the casing 32*a* via the electric pole 332, the protrusion 3315*a* of the lamp cap 33*a* is received in the guiding groove 326*a* of the casing 32*a*. After an electric shell 331*a* of the lamp cap 33*a* had been screwed into the lamp holder 400, the protrusion 3315*a* of the lamp cap 33*a* can slide along the guiding groove 326*a* relative to the casing 32*a* by rotating the casing 32*a* reversely to adjust the illumination direction of the LED lamp 100*a*. The block 327*a* formed in the guiding groove 326*a* limits a relative rotation between the lamp cap 33*a* and the casing 32*a* within a predetermined angle.

As shown in FIG. 5, in this embodiment, an annular inner wall 328 is formed on the outer surface of the bottom plate 321 of the casing 32*a* and concentric with the through hole 3211 of the bottom plate 321. When the lamp cap 33*a* is rotatablely connected to the casing 32*a*, the inner wall 328 of the casing 32*a* is received in the electric shell 331*a* of the lamp cap 33*a*. The guiding groove 326*a* of the casing 32*a* is defined in an outer circumferential surface of the inner wall 328 and located adjacent to the bottom plate 321. The outer circumferential surface of the inner wall 328 further axially defines a straight groove 329 communicating with the guiding groove 326*a* to allow the protrusion 3315*a* of the lamp cap 33*a* to slide into the guiding groove 326*a* when assembling the casing 32*a* and the lamp cap 33*a* together. The block 327*a* is located adjacent to the straight groove 329. A side of the block 327*a* is aligned with an edge of the straight groove 329. The protrusion 3315*a* of the lamp cap 33*a* is formed on an end of the electric shell 331*a* adjacent to the casing 32*a* and extends inwardly towards the inner wall 328. Further, an annular protecting wall 325*a* is arranged on the outer surface of the bottom plate 321 of the casing 32*a* and concentric with the through hole 3211. The protecting wall 325*a* is disposed around the electric shell 331*a* of the lamp cap 33*a* to guide the rotation of the electric shell 331*a* and to prevent people from touching the electric shell 331*a*, to thereby improve the safety of the LED lamp 100*a*. For clarity, the protecting wall 325*a* is removed from the casing 32*a* shown in FIG. 5.

Figure 6:
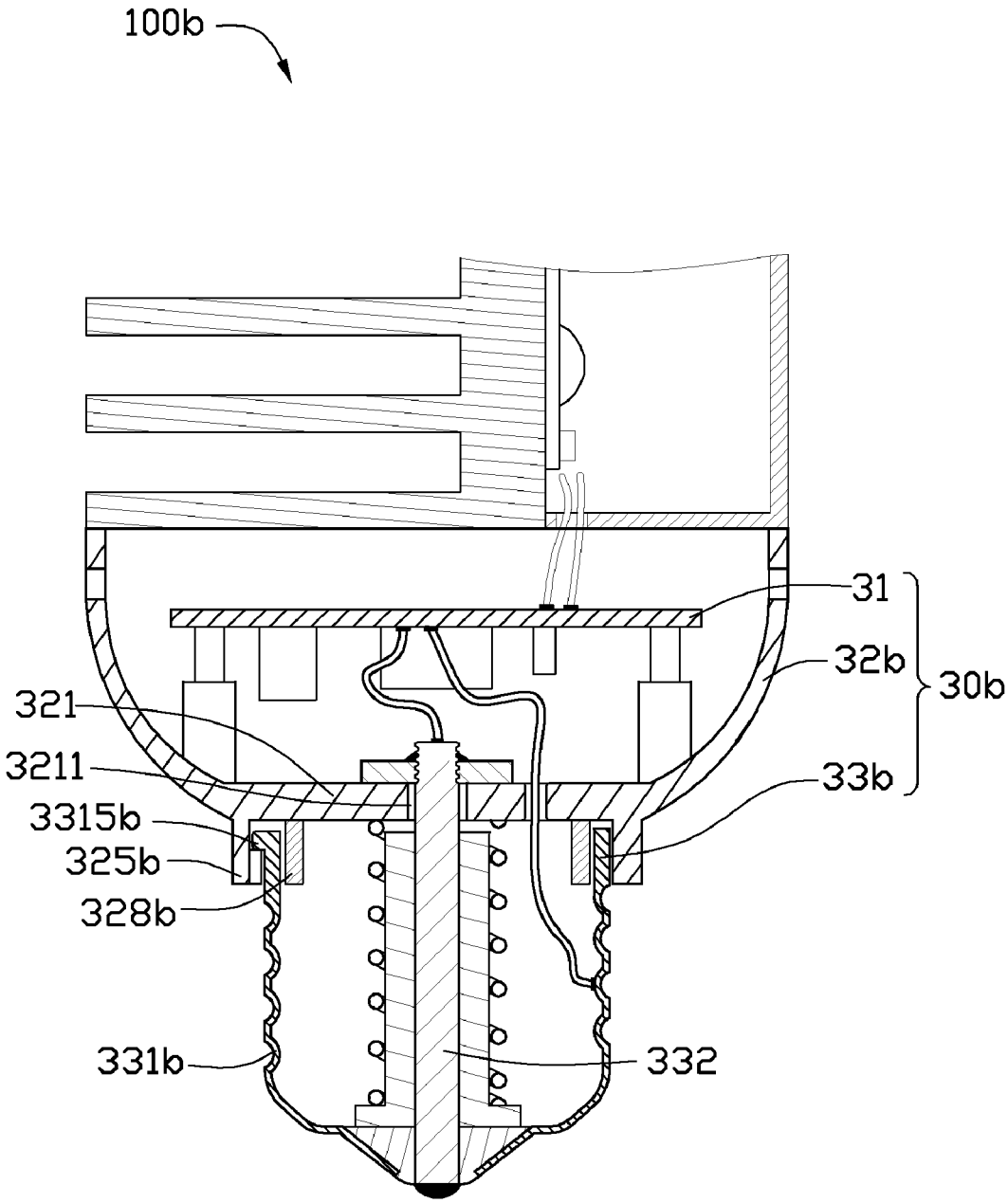
FIG. 6 is a cross-sectional view of an LED lamp in accordance with a third embodiment of the present disclosure.
Figure 7:
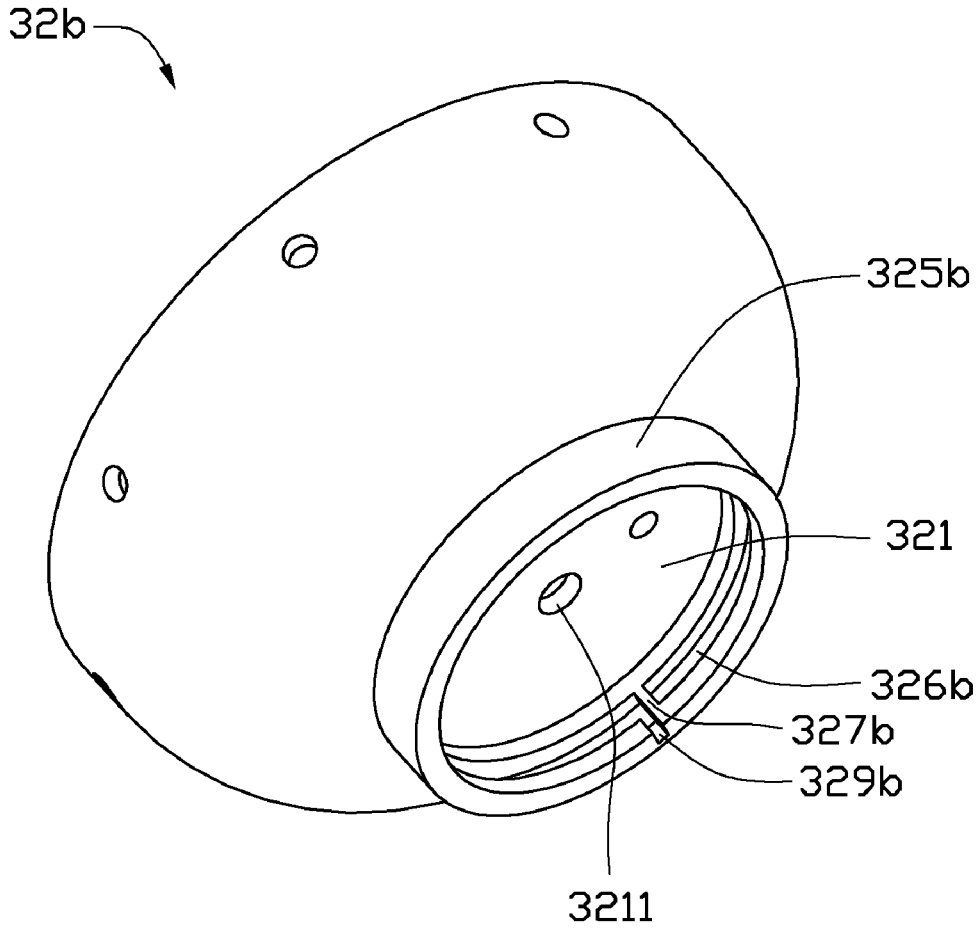
FIG. 7 is an isometric view of a casing of the LED lamp of FIG. 6.

Referring to FIGS. 6 and 7, an LED lamp 100*b* according to a third embodiment is illustrated. The difference between the LED lamp 100*b* of this embodiment and the LED lamp 100 of the first embodiment also lies in the position of an orientation-adjusting structure. In this embodiment, an electric part 30*b* of the LED lamp 100*b* includes the circuit board 31, a casing 32*b* and a lamp cap 33*b*. The lamp cap 33*b* is rotatablely connected to the casing 32*b*. The orientation-adjusting structure is provided between the casing 32*b* and the lamp cap 33*b*. The orientation-adjusting structure includes an annular guiding groove 326*b* defined in the casing 32*b*, a block 327*b* formed in the guiding groove 326*b*, and a protrusion 3315*b* formed on the lamp cap 33*b*. When the lamp cap 33*b* is rotatablely connected to the casing 32*b* via the electric pole 332, the protrusion 3315*b* of the lamp cap 33*b* is received in the guiding groove 326*b* of the casing 32*b*. After an electric shell 331*b* of the lamp cap 33*b* had been screwed into the lamp holder 400, the protrusion 3315*b* of the lamp cap 33*b* can slide along the guiding groove 326*b* relative to the casing 32*b* by rotating the casing 32*b* reversely to adjust the illumination direction of the LED lamp 100*b*. The block 327*b* formed in the guiding groove 326*b* limits a relative rotation between the lamp cap 33*b* and the casing 32*b* within a predetermined angle.

Referring also to FIG. 7, in this embodiment, an annular protecting wall 325*b* is formed on the outer surface of the bottom plate 321 of the casing 32*b* and concentric with the through hole 3211. When the lamp cap 33*b* is rotatablely connect to the casing 32*b*, the protecting wall 325*b* is disposed around an electric shell 331*b* of the lamp cap 33*b* to guide the rotation of the electric shell 331*b* and to prevent people from touching the electric shell 331*b*, to thereby improve the safety of the LED lamp 100*b*. The guiding groove 326*b* of the casing 32*b* is defined in an inner circumferential surface of the protecting wall 325*b* and located adjacent to the bottom plate 321. The inner circumferential surface of the protecting wall 325*b* further axially defines a straight groove 329*b* communicating with the guiding groove 326*b* to allow the protrusion 3315*b* of the lamp cap 33*b* slide into the guiding groove 326*b* when assembling the lamp cap 33*b* and the casing 32*b* together. The block 327*b* is located adjacent to the straight groove 329*b*. A side of the block 327*b* is aligned with an edge of the straight groove 329*b*. The protrusion 3315*b* of the lamp cap 33*b* is formed on an end of the electric shell 331*b* adjacent to the casing 32*b* and extends outwardly towards the protecting wall 325*b*. Further, an annular inner wall 328*b* is arranged on the outer surface of the bottom plate 321 of the casing 32*b* and concentric with the through hole 3211. The inner wall 328*b* is received in the electric shell 331*b* of the lamp cap 33*b* for guiding the rotation of the electric shell 331*b*. For clarity, the inner wall 328*b* is removed from the casing 32*b* shown in FIG. 7.

Figure 8:
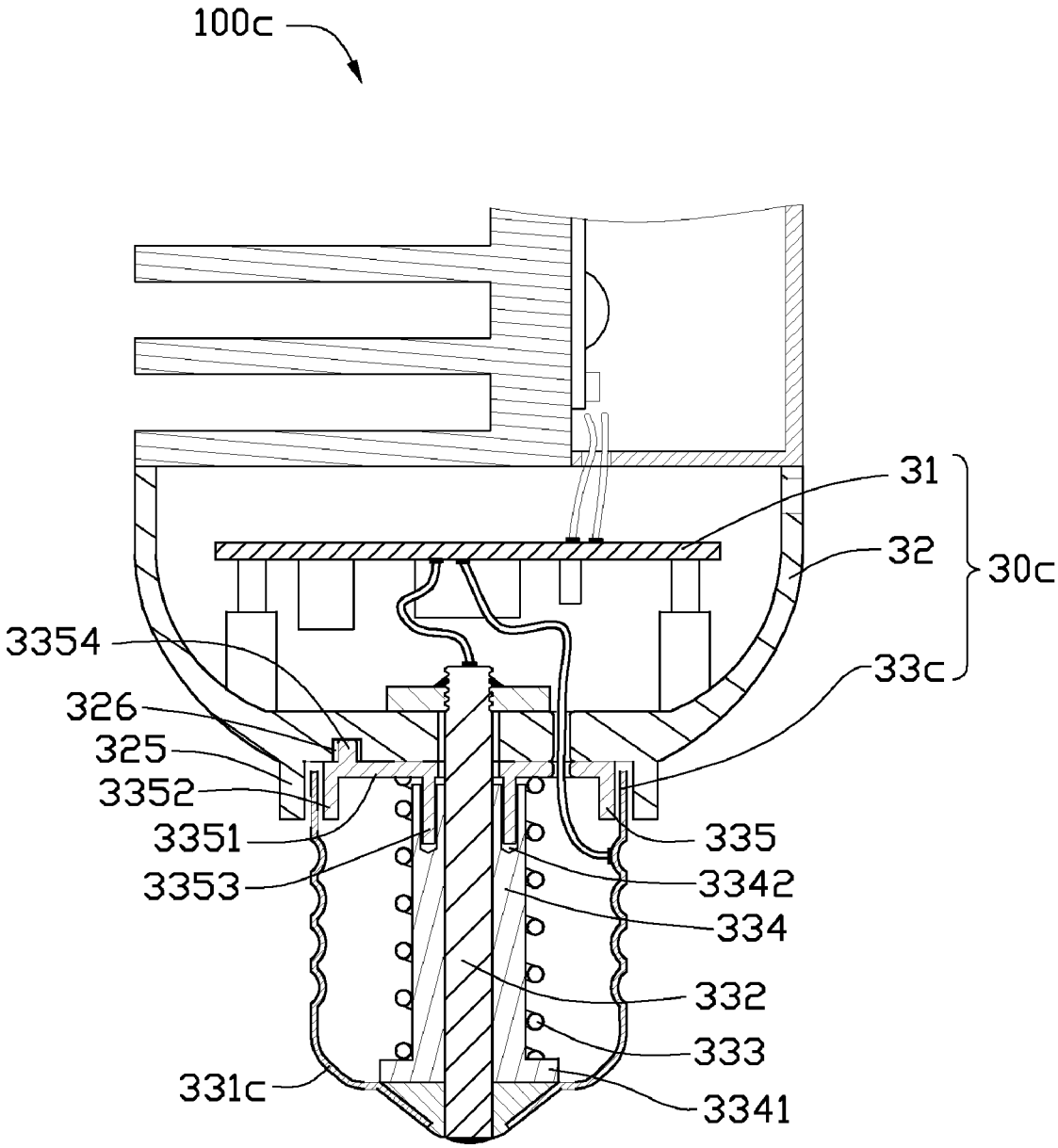
FIG. 8 is a cross-sectional view of an LED lamp in accordance with a fourth embodiment of the present disclosure.
Figure 9:
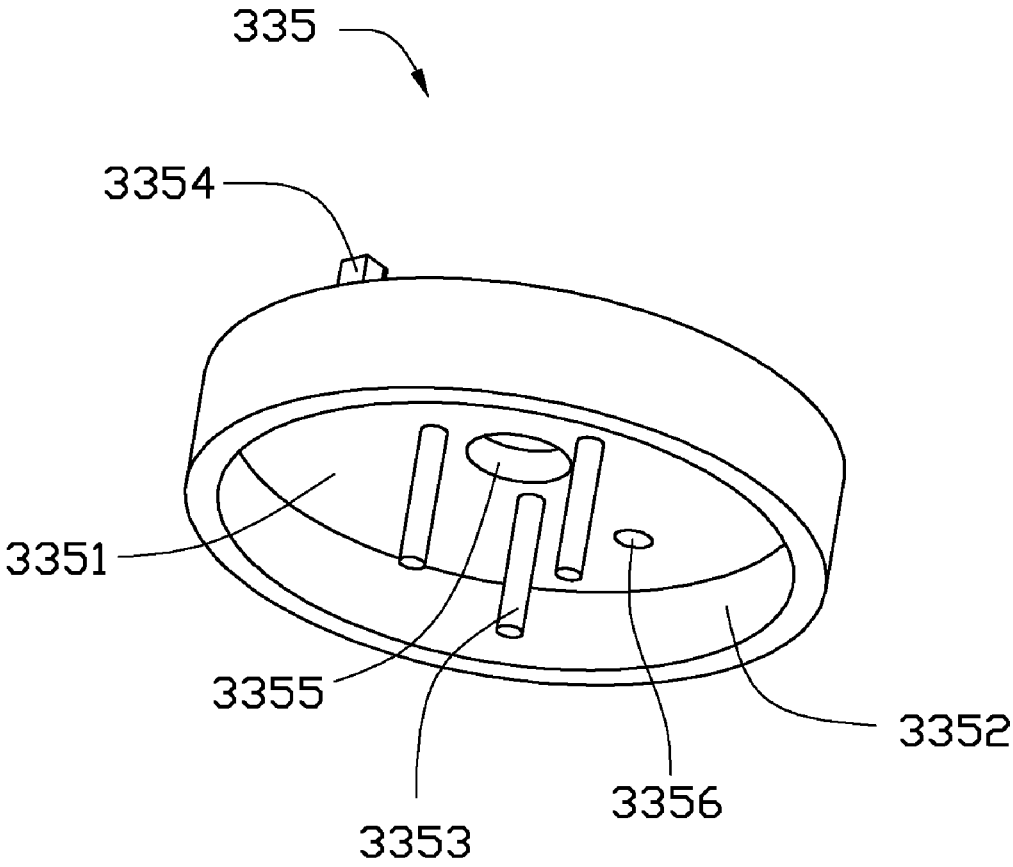
FIG. 9 is an isometric view of a connecting member of a lamp cap of the LED lamp of FIG. 8.

Referring to FIGS. 8 and 9, an LED lamp 100*c* according to a fourth embodiment is illustrated. In this embodiment, an electric part 30*c* of the LED lamp 100*c* includes the circuit board 31, the casing 32 (best see in FIG. 3) and a lamp cap 33*c*. The lamp cap 33*c* is rotatablely connected to the casing 32 via the electric pole 332. An orientation-adjusting structure is provided between the casing 32 and the lamp cap 33*c*. The orientation-adjusting structure includes the annular guiding groove 326 defined in the casing 32, the block 327 formed in the guiding groove 326, and a protrusion 3354 formed on the lamp cap 33*c*. When the lamp cap 33*c* is rotatablely connected to the casing 32, the protrusion 3354 of the lamp cap 33*c* is received in the guiding groove 326 of the casing 32. After the electric shell 331*c* of the lamp cap 33*c* had been screwed into the lamp holder 400, the protrusion 3354 of the lamp cap 33*c* can slide along the guiding groove 326 relative to the casing 32 by rotating the casing 32 reversely to adjust the illumination direction of the LED lamp 100*c*. The block 327 formed in the guiding groove 326 limits a relative rotation between the lamp cap 33*c* and the casing 32 within a predetermined angle. The difference between the LED lamp 100*c* of this embodiment and the LED lamp 100 of the first embodiment only lies in the lamp cap 33*c* of the electric part 30*c*.

As shown in FIG. 9, in this embodiment, besides the electric shell 331*c*, the electric pole 332, the coil spring 333 and the positioning sleeve 334, the lamp cap 33 further includes a connecting member 335. The connecting member 335 includes a positioning plate 3351, and an annular inner wall 3352 extending downwardly from a periphery of the positioning plate 3351 towards the end plate of the electric shell 331*c*. The positioning plate 3351 has a first surface facing the bottom plate 321 of the casing 32 and a second surface opposite to the first surface. The protrusion 3354 of the lamp cap 33 is formed on the first surface of the positioning plate 3351 facing the bottom plate 321 of the casing 32. A plurality of parallel pins 3353 are formed on the second surface of the positioning plate 3351. The positioning sleeve 334 defines a plurality of receiving holes 3342 in an end thereof facing the casing 32 and corresponding to the pins 3353 of the connecting member 335. Further, the positioning plate 3351 of the connecting member 335 defines a through hole 3355 therein for insertion of the electric pole 332 and a wire hole 3356 therein for passing of one of the pair of second wire.

In assembly of the lamp cap 33*c* and the casing 32, the positioning sleeve 334 is disposed around the electric pole 332 and can be rotated together with the electric pole 332. The connecting member 335 is disposed around the electric pole 332 and arranged between the casing 32 and the positioning sleeve 334. The pins 3353 of the connecting member 335 are received in the receiving holes 3342 of the positioning sleeve 334, to thereby make the connecting member 335 can be rotated together with the positioning sleeve 334. The protrusion 3354 of the lamp cap 33 is received in the guiding groove 326 of the casing 32. The coil spring 333 is compressed between the flange 3341 of the positioning sleeve 334 and the positioning plate 3351 of the connecting member 335 to provide elastic force, to thereby keep the protrusion 3354 of the lamp cap 33*c* always received in the guiding groove 326 of the casing 32 and to prevent the lamp cap 33 from moving along the axial direction of the electric shell 331*b* relative to the casing 32. The inner wall 3352 of the connecting member 335 is received in the electric shell 331*c* for guiding the rotation of the electric shell 331*c*.

When the lamp cap 33*c* of the LED lamp 100*c* is screwed into the lamp holder 400, the protrusion 3354 of the lamp cap 33*c* slides along the guiding groove 326 relative to the casing 32 until the protrusion 3354 meets the block 327 formed in the guiding groove 326. Then the connecting member 335 of the lamp cap 33*c* is rotated together with the casing 32, driving the entire lamp cap 33*c* to rotate in the screw cap 42 of the lamp holder 400 until the outer end 3322 of the electric pole 332 intimately contacts with the resilient flake 43 of the lamp holder 400. After the electric shell 331*c* of the lamp cap 33*c* had been screwed into the lamp holder 400, by rotating the casing 32 reversely, the protrusion 3354 of the lamp cap 33*c* formed on the connecting member 335 is disengaged from the block 327 and slides along the guiding groove 326 relative to the casing 32 towards a reverse direction. Therefore, the LED lamp 100*c* can be easily adjusted to a desired position.

It is to be understood, however, that even though numerous characteristics and advantages of the present invention have been set forth in the foregoing description, together with details of the structure and function of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An LED lamp, comprising:

a heat dissipation part comprising a heat dissipation member;

an optical part comprising an LED module and an envelope, the LED module being thermally attached to the heat dissipation member, the envelope being mounted on the heat dissipation member and covering the LED module; and an electric part arranged at bottom ends of the heat dissipation part and the optical part, the electric part comprising:

a casing comprising a bottom plate and an annular sidewall extending from a periphery of the bottom plate to connect with the heat dissipation part and the optical part;

a circuit board received in the casing and electrically connected to the LED module, and a lamp cap located at an outer side of the bottom plate of the casing, the lamp cap comprising an electric shell and an electric pole axially inserted in the electric shell, an inner end of the electric shell adjacent to the casing extending through a through hole defined in the bottom plate of the casing to rotatablely connect the lamp cap with the casing, an outer end of the electric pole far from the casing extending through the electric shell, the outer end of the electric pole being fixedly connected to and electrically insulated from the electric shell, an orientation-adjusting structure being provided between the casing and the lamp cap for adjusting the illumination direction of the LED lamp, by the orientation-adjusting structure when the lamp cap is screwed into a lamp holder to electrically connect therewith, the casing being rotated with the lamp cap till reaching a first position in which the lamp cap is electrically connected with the lamp holder and the lamp cap and the casing both are stopped from further rotation in the screwing-in direction, and the casing is rotatable in a reverse direction till reaching a second position during which the lamp cap is kept as stationary and in electrical connection with the lamp holder, from the second position, a further rotation of the casing in the reverse direction causing the lamp cap to rotate in the reverse direction and to lose its electrical connection with the lamp holder.

2. The LED lamp of claim 1, wherein the orientation-adjusting structure comprises an annular guiding groove defined in the casing, a block formed in the guiding groove, and at least one protrusion formed on the lamp cap, the protrusion of the lamp cap being received in the guiding groove of the casing, after the electric shell of the lamp cap had been screwed into the lamp holder and reached the first position, the protrusion of the lamp cap can slide along the guiding groove relative to the casing by rotating the casing in the reverse direction to adjust the illumination direction of the LED lamp, the block formed in the guiding groove limiting a relative rotation between the lamp cap and the casing within a predetermined angle between the first and second positions.

3. The LED lamp of claim 1, wherein the lamp cap further comprises a coil spring received in the electric shell and disposed around the electric pole, the coil spring being compressed between the bottom plate of the casing and the end plate of the electric shell.

4. The LED lamp of claim 1, wherein the casing is bowl-shaped and has an opening facing the casing, the sidewall of the casing extending outwardly from a periphery of the bottom plate towards the heat dissipation part and the optical part.

5. The LED lamp of claim 1, wherein a plurality of air passage apertures are defined through the casing at a position adjacent to the heat dissipation part and the optical part.

6. The LED lamp of claim 1, wherein the heat dissipation member comprises a base and a plurality of fins extending outwardly from a side of the base, and the LED module is attached on an opposite side of the base.

7. The LED lamp of claim 2, wherein the guiding groove of the casing is defined in an outer surface of the bottom plate, and the at least one protrusion of the lamp cap is formed on an end of the electric shell adjacent to the casing and extends towards the casing.

8. The LED lamp of claim 2, wherein an annular inner wall is formed on an outer surface of the bottom plate of the casing and concentric with the through hole of the bottom plate, the inner wall of the casing is received in the electric shell of the lamp cap, the guiding groove of the casing is defined in an outer circumferential surface of the inner wall, the protrusion of the lamp cap is formed on an end of the electric shell adjacent to the casing and extends towards the inner wall, and the outer circumferential surface of the inner wall further axially defines a straight groove communicating with the guiding groove to allow the protrusion of the lamp cap to slide into the guiding groove.

9. The LED lamp of claim 2, wherein an annular protecting wall is formed on the outer surface of the bottom plate of the casing and concentric with the through hole of the bottom plate, an end of the electric shell adjacent to the casing is received in the protecting wall, the guiding groove of the casing is defined in an inner circumferential surface of the protecting wall, the protrusion of the lamp cap is formed on an end of the electric shell adjacent to the casing and extends towards the protecting wall, and the inner circumferential surface of the protecting wall further axially defines a straight groove communicating with the guiding groove to allow the protrusion of the lamp cap to slide into the guiding groove.

10. The LED lamp of claim 2, wherein the lamp cap further comprises a positioning sleeve and a connecting member, the positioning sleeve being received in the electric shell and disposed around the electric pole, the positioning sleeve can be rotated together with the electric pole, the connecting member being disposed around the electric pole and arranged between the casing and the positioning sleeve, the connecting member being coupled to the positioning sleeve and can be rotated together with the positioning sleeve, the protrusion of the lamp cap being formed on the connecting member.

11. The LED lamp of claim 6, wherein the base extends along an axial direction of the electric pole.

12. The LED lamp of claim 10, wherein the connecting member comprises a positioning plate, the positioning plate having a first surface facing the bottom plate of the casing and a second surface opposite to the first surface, the protrusion of the lamp cap being formed on the first surface of the positioning plate, a plurality of pins being formed on the second surface of the positioning plate, the positioning sleeve defining a plurality of receiving holes in an end thereof facing the casing corresponding to the pins of the connecting member, the pins of the connecting member being received in the receiving holes of the positioning sleeve.

13. The LED lamp of claim 12, wherein the lamp cap further comprises a coil spring received in the electric shell and disposed around the positioning sleeve, the coil spring being compressed between the positioning plate of the connecting member and the end plate of the electric shell.

14. The LED lamp of claim 3, wherein the lamp cap further comprises a positioning sleeve received in the electric shell and disposed around the electric pole, the positioning sleeve being sandwiched between the electric pole and the coil spring.

* * * * *